US010233582B2

(12) United States Patent
Li et al.

(10) Patent No.: US 10,233,582 B2
(45) Date of Patent: Mar. 19, 2019

(54) CONTROL METHOD OF DUAL-DRUM WASHING MACHINE

(71) Applicant: QINGDAO HAIER DRUM WASHING MACHINE CO., LTD., Qingdao, Shandong (CN)

(72) Inventors: Wenwei Li, Shandong (CN); Jinkai Wang, Shandong (CN); Yuanyuan Chang, Shandong (CN); Haibo Wang, Shandong (CN)

(73) Assignee: QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 103 days.

(21) Appl. No.: 15/535,346

(22) PCT Filed: Aug. 31, 2015

(86) PCT No.: PCT/CN2015/088591
§ 371 (c)(1),
(2) Date: Jun. 12, 2017

(87) PCT Pub. No.: WO2016/090969
PCT Pub. Date: Jun. 16, 2016

(65) Prior Publication Data

US 2017/0342626 A1 Nov. 30, 2017

(30) Foreign Application Priority Data

Dec. 12, 2014 (CN) ..... 2014 1 0773012

(51) Int. Cl.
*D06F 29/00* (2006.01)
*D06F 33/02* (2006.01)
(Continued)

(52) U.S. Cl.
CPC ..... *D06F 33/02* (2013.01); *D06F 25/00* (2013.01); *D06F 29/00* (2013.01); *D06F 31/00* (2013.01);
(Continued)

(58) Field of Classification Search
CPC ..... D06F 29/00
See application file for complete search history.

(56) References Cited

U.S. PATENT DOCUMENTS 4,663,948 A 5/1987 Rummel
2008/0022465 A1 1/2008 Jun et al.
(Continued)

FOREIGN PATENT DOCUMENTS

CN 101113557 A 1/2008
CN 101153455 A 4/2008
(Continued)

OTHER PUBLICATIONS

Extended European Search Report dated Dec. 6, 2017, issued by the European Patent Office in corresponding European Application No. 15867380.6 (8 pages).
(Continued)

*Primary Examiner* — Jason Y Ko
(74) *Attorney, Agent, or Firm* — Buchanan Ingersoll & Rooney PC

(57) ABSTRACT

A control method of a double-drum washing machine, having a first washing drum and a second washing drum. Whether the heating time required by the first drum is overlong is judged before the first drum performs heating. If yes, the second drum executes the heating, or dewatering, or drying processes. If not, the following steps are performed:
judging whether the second drum performs heating;
if yes, judging whether the remaining heating time of the second washing drum is greater than $T_0$;
(Continued)

if the judgment result is yes, executing the alternate heating program that the first drum and the second washing drum perform heating alternately, and if the judgment result is no, executing the ordered heating program that the second drum performs heating firstly, and then the first drum performs heating, wherein $T_0$ is a time value for judging whether the heating of the second drum is about to finish or not.

15 Claims, 6 Drawing Sheets

(51) Int. Cl.

| | |
|---|---|
| ***D06F 31/00*** | (2006.01) |
| ***D06F 25/00*** | (2006.01) |
| ***D06F 39/04*** | (2006.01) |
| *D06F 37/02* | (2006.01) |

(52) U.S. Cl.

CPC ..... *D06F 39/04* (2013.01); *D06F 39/045* (2013.01); *D06F 37/02* (2013.01); *D06F 2202/04* (2013.01); *D06F 2202/085* (2013.01); *D06F 2202/12* (2013.01); *D06F 2204/04* (2013.01); *D06F 2220/00* (2013.01)

(56) References Cited

U.S. PATENT DOCUMENTS

| | | | |
|---|---|---|---|
| 2008/0052950 | A1 | 3/2008 | Park et al. |
| 2009/0133197 | A1 | 5/2009 | Lee et al. |
| 2012/0047661 | A1 | 3/2012 | Hong et al. |

FOREIGN PATENT DOCUMENTS

| | | | |
|---|---|---|---|
| CN | 102203337 | A | 9/2011 |
| EP | 1882768 | A2 | 1/2008 |
| JP | S63127788 | A | 5/1988 |

OTHER PUBLICATIONS

International Search Report (PCT/ISA/210) dated Dec. 11, 2015, by the State Intellectual Property Office of the P.R. China as the International Searching Authority for International Application No. PCT/CN2015/088591.

Written Opinion (PCT/ISA/237) dated Dec. 11, 2015, by the State Intellectual Property Office of the P.R. China as the International Searching Authority for International Application No. PCT/CN2015/088591.

CONTROL METHOD OF DUAL-DRUM WASHING MACHINE

FIELD OF THE INVENTION

The present disclosure relates to the technical field of control of washing machines, in particular to a control method of a double-drum washing machine.

BACKGROUND OF THE INVENTION

At present, a drum washing machine which is on sale in the market is only provided with one washing drum. With the improvement of people's life quality, people's health awareness is also gradually increased, and particularly in the aspect of family laundry, more and more people wash clothes separately. For example, underwear and outerwear are separately washed; infant clothes and adult clothes are separately washed; clothes with different colors are separately washed or a small number of clothes are washed in time. If the aforementioned washing mode is realized by adopting a conventional washing machine, not only can a great deal of energy and water be wasted, but also it is difficult to meet the sanitary requirements of users. If two or more washing machines are purchased to meet needs, not only is the cost increased, but also the trouble that a large space is occupied can be brought.

Therefore, a double-drum washing machine is adopted, so that the requirements can be met, the cost can be sufficiently controlled and the problem that energy, water and space are wasted can be solved. Reasonable double-drums are designed to be arranged up and down, so that saving of the space is facilitated, but subsequently, the control problem of the use power of the complete machine is brought, and particularly, the use stability and the service life of the machine are seriously affected by an overload condition caused when heating, drying and high-speed dewatering are performed at the same time.

There is now a patent for the design and control method of a double drum or multi-drum washing machine, in which the heating control method for the double drum machine is also patented. In the patent application No CN200880124154.4, a method relates to a control logic for heating in the use of the double-drum washing machine: the two drums perform heating alternately or in order, and the priorities of the two drums are determined by judging the remaining washing time when commands are received at the same time.

But according to the control method disclosed by the patent mentioned above, a single ordered heating control method or a single alternate control method is disclosed, and a manner that the single ordered heating control method and the single alternate control method are combined in an actual use process can exist, but is undisclosed in the patent document. And in addition, it seems to be complex in the control of the double drums in the patent document, and it is not comprehensive enough for power control.

SUMMARY OF THE INVENTION

In order to solve the problems, the present disclosure provides a control method of a double-drum washing machine, and the control method particularly adopts the technical scheme as follows.

A control method of a double-drum washing machine is provided, and the washing machine at least comprises a first washing drum and a second washing drum. Whether the heating time required by the first washing drum is overlong or not is judged before the first washing drum performs heating. If yes, the second washing drum preferentially executes the heating, or dewatering, or drying processes, if not, the following step is performed:

step S101: judging whether the second washing drum performs heating or not;

step S102: if yes, judging whether the remaining heating time of the second washing drum is greater than $T_0$ or not;

step S103: if the judgment result is yes, executing the alternate heating program that the first washing drum and the second washing drum perform heating alternately, and if the judgment result is not, executing the ordered heating program that the second washing drum performs heating firstly, and then the first washing drum performs heating, wherein $T_0$ is a time value set in the control method for judging whether the heating of the second washing drum is about to finish or not.

Further, the judgment on whether the heating time required by the first washing drum is overlong or not comprises the following judgment conditions:

a) whether a set heating temperature of the first washing drum is higher than a normal set temperature or not;

b) whether a water intake quantity of the first washing drum is greater than common water intake quantity or not;

c) whether a difference of the set heating temperature value and a real-time measurement value of the first washing drum is greater than a difference of a set heating temperature value and a real-time measurement value of the second washing drum or not;

if all the judgment results in a), b) and c) are not, determining that the heating time required by the first washing drum is not overlong; and if any one of the judgment results in a), b) and c) is yes, determining that the heating time required by the first washing drum is overlong.

The normal set temperature in the judgment condition a) accounts for 60%-90% of the maximum heating temperature set in the system; preferably, the normal set temperature accounts for 70%-80% of the maximum heating temperature set in the system; and preferably, X=60° C.

Further, the common water intake quantity in the judgment condition b) accounts for 80%-95% of the maximum water intake quantity set in the system, and preferably, the common water intake quantity accounts for 95%-95% of the maximum water intake quantity set in the system.

Further, the first washing drum is provided with a plurality of water intake water levels, which, comes and to different water intake quantities, the common water intake quantity corresponds to a common water intake water level, the common water intake water level is higher than a minimum water intake water level and lower than a maximum water intake water level.

The judgment according to the judgment condition b) is realized in the following manners:

judging whether the water intake water level set for the first washing drum is higher than the water intake water level corresponding to the common water intake quantity or not.

If yes, determining that the water intake quantity set for the first washing drum is greater than the common water intake quantity, if not, determining that the water intake quantity set for the first washing drum is smaller than the common water intake quantity.

Further, when the judgment result of judging whether the heating time needed by the first washing drum is overlong is not, executes the following judgment.

It is judged whether the second washing drum is performing any one of the heating, or dewatering, or drying process, if the result is yes, the first washing drum waits until the corresponding heating, or dewatering, or heating process of the second washing drum is completed and then heats. If the result is not, the first washing drum performs heating.

Further, the total heating time of the second washing drum is $T_{m2}$, and $0<T_0\leq 1/3\ T_{m2}$, and preferably, $0<T_0\leq 5$ min.

Further, in the alternate heating program in step S103:

After the heating time interval of the first washing drum reaches $T_1$, it is judged whether the temperature of the first washing drum is equal to the preset temperature. If yes, the first washing drum stops heating and the second washing drum keeps heating to the preset temperature. If not, the first washing drum pauses heating and the second washing drum heats.

After the heating time interval of the second washing drum reaches $T_2$, it is judged whether the temperature of the second washing drum is equal to the preset temperature. If yes, the second washing drum stops heating and the first washing drum keeps heating to the preset temperature. If not, the second washing drum pauses heating and the first washing drum heats.

Further, $T_1$ and $T_2$ are respective minimum time intervals when the first washing drum and the second washing drum perform heating every time, and preferably, $T_1$ is equal to $T_2$.

Further, the first washing drum is independently provided with a first heating means for heating the first washing drum, and the second washing drum is independently provided with a second heating means far heating the second washing drum.

The first washing drum and the second washing drum are respectively provided with a first sensor and a second sensor for monitoring the water intake water level.

In the control method in the present disclosure, whether the heating time required by the first washing drum is overlong or not is judged before the first washing drum performs heating: if the heating time required by the first washing drum is overlong, because the heating time of the first washing drum, is relatively long, the second washing drum is used for preferentially executing the high-power process such as the heating, or dewatering, or drying process; then, the first washing drum starts to perform heating, so that the phenomenon that the waiting time of the second washing drum is overlong because the heating time of the first washing drum is overlong is avoided. And if the heating time required by the first washing drum is not overlong, it indicates that the normal heating time of the first washing drum or the heating time required by the washing drum is relatively short, so that the program that the first washing drum preferentially performs heating or the first washing drum and the second washing drum perform heating alternately is selected, and the heating waiting time of the first washing drum is shortened.

In addition, if the heating time required by the first washing drum is not overlong, the control method in the present disclosure realizes heating control on the double-drum washing machine in an ordered heating and alternate heating combined manner, and the corresponding heating manner is selected by judging whether the heating process of the drum executing the heating process is about to finish or not. Therefore, the corresponding heating process is adopted according to the actual use condition in the control method provided by the present disclosure, so that the heating efficiency is higher, and the power control is more precise.

The present invention also has the following advantageous effects:

1. Before one washing drum executes the heating process, it is judged whether the other washing drum is performing high power process such as heating, dewatering or drying, etc. to avoid the two washing drum performing the high power process at the same time. Thus it can reduce the loss of the washing machine and reduce the instantaneous power of the washing machine to improve the applicable environment of the double-drum washing machine to extend the service life of the washing machine.

2. The present disclosure has simpler control logic, and higher control stability in an actual washing process. In a general washing case, it is possible to control the two drums not to perform the high power process at the same time and to control the heating time in the washing reasonably. Thus, it ensures the stability of the washing machine.

In summary, the heating control method of the present disclosure is simple and reliable with great benefits and is suitable to promote.

Figure 1:
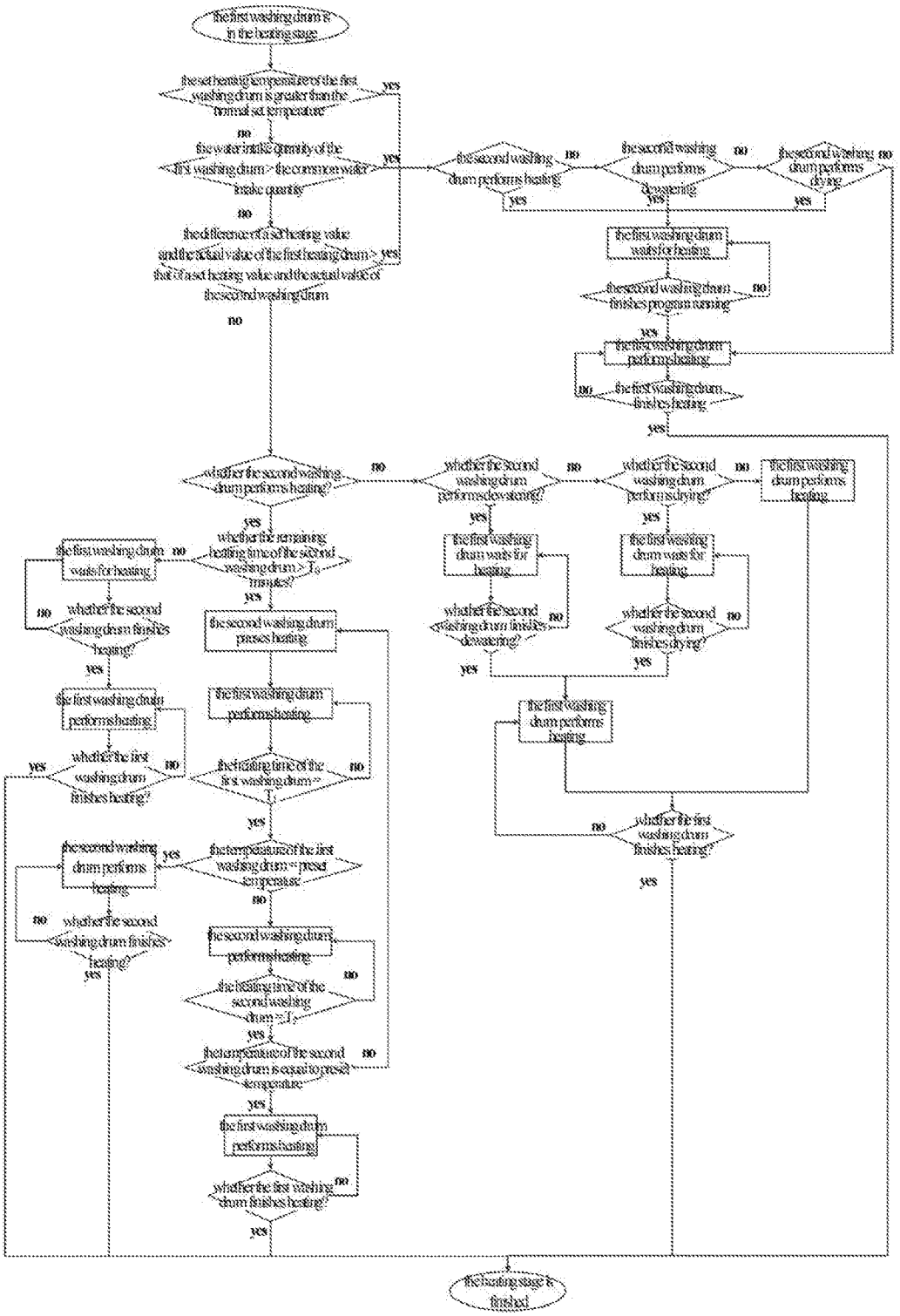
FIG. 1 is a flow block diagram of the present disclosure.

Reference signs in the drawings: 1—first washing drum; 2—second washing drum.

DETAILED DESCRIPTION OF THE INVENTION

A control method of a double-drum washing machine, provided by the present disclosure, is described in detail below in conjunction with the drawings:

As shown in FIG. 1, a control method of a double-drum washing machine of the present disclosure, the washing machine at least comprises the first washing drum and the second washing drum, whether the heating time required by the first washing drum is overlong or not is judged before the first washing drum performs heating. If yes, the second washing drum preferentially executes the heating, or dewatering, or drying processes, if not, the following step is performed:

step S101: judging whether the second washing drum performs heating or not;

step S102: if yes, judging whether the remaining heating time of the second washing drum is greater than $T_0$ or not;

step S103: if the judgment result is yes, executing the alternate heating program that the first washing drum and the second washing drum perform heating alternately, and if the judgment result is not, executing the ordered heating program that the second washing drum performs heating firstly, and then the first washing drum performs heating, wherein $T_0$ is a time value set in the control method for judging whether the heating of the second washing drum is about to finish or not.

In the control method of the present disclosure, whether the heating time required by the first washing drum is overlong or not is judged before the first washing drum performs heating; if the heating time required by the first washing drum is overlong, because the heating time of the first washing drum is relatively long, the second washing drum is used for preferentially executing the high-power process such as the heating, or dewatering, or drying process; then, the first washing drum starts to perform heating, so that the phenomenon that the waiting time of the second washing drum is overlong because the heating time of the first washing drum is overlong is avoided. And if the heating time required by the first washing drum is not overlong, it indicates that the normal heating time of the first washing drum or the heating time required by the washing drum is relatively short, so that the program that the first washing drum preferentially performs heating or the first washing drum and the second washing drum perform heating alternately is selected, and the heating waiting time of the first washing drum is shortened.

Compared with the maximum heating time of the washing drums, whether the heating time required by the first washing drum in the present disclosure is overlong or not is judged, i.e., it can be believed that the heating time required by the first washing drum at the moment exceeds a common heating time range and is overlong when the heating time required by the first washing drum approaches to or reaches the maximum heating time. And it can be believed that the heating time required by the first washing drum is within the common heating time range and is not overlong when the heating time required by the first washing drum does not approach to the maximum heating time, i.e., a certain time interval exists, between the heating time required by the first washing drum and the maximum heating time.

In addition, if the heating time required by the first washing drum is not overlong, the control method in the present disclosure realizes heating control on the double-drum, washing machine in an ordered heating and alternate heating combined manner, and the corresponding heating manner is selected by judging whether the heating process of the drum executing the heating process is about to finish or not. Therefore, the corresponding heating process is adopted according to the actual use condition in the control method provided by the present disclosure, so that the heating efficiency is higher, and the power control is more precise.

As a preferred embodiment of the present disclosure, the judgment on whether the heating time required by the first washing drum is overlong or not comprises the following judgment conditions:

a) whether a set heating temperature of the first washing drum is higher than a normal set temperature or not;

b) whether a water intake quantity of the first washing drum is greater than common water intake quantity or not;

c) whether a difference of the set heating temperature value and a real-time measurement value of the first washing drum is greater than a difference of a set heating temperature value and a real-time measurement value of the second washing drum or not;

if all the judgment results in a), b) and c) are not, determining that the heating time required by the first washing drum is not overlong; and if any one of the judgment results in a), b) and c) is yes, determining that the heating time required by the first washing drum is overlong.

Specifically, the normal set temperature in the judgment condition a) in the present disclosure is smaller than the maximum beating temperature value set for the first washing drum in the method. The clothes washing cleanliness can be improved when the washing water is heated to achieve a certain temperature. But if the heating temperature is over high, on one hand, the fabric of clothes can be damaged, on the other hand, the use experience of a user can also be greatly reduced by overlong heating time, high power consumption and other problems brought by high heating temperature. And therefore, the normal set temperature accounts for 60%-90% of the maximum heating temperature set in the method; preferably, the normal set temperature accounts for 70%-80% of the maximum beating temperature set in the method; and preferably, X=60° C.

Similarly, the common water intake quantity in the judgment condition b) in the present disclosure accounts for 80%-95% of the maximum water intake quantity set in the method, and preferably, the common water intake quantity accounts for 95%-95% of the maximum water intake quantity set in the method.

The water intake quantity of the washing machine is indirectly presented by setting of water intake water levels in actual use. Therefore, the first washing drum for the control method disclosed by the present disclosure is provided with a plurality of water intake water levels which correspond to different water intake quantities, the common water intake quantity corresponds to a common water intake water level which is higher than the minimum water intake water level and lower than the maximum water intake water level.

The judgment according to the judgment condition b) is realized in the following manners:

judging whether the water intake water level set far the first washing drum is higher than the water intake water level corresponding to the common water intake quantity or not.

If yes, determining that the water intake quantity set for the first washing drum is greater than the common water intake quantity, if not, determining that the water intake quantity set for the first washing drum is smaller than the common water intake quantity.

Specifically, five water intake water levels including a low water intake water level, a medium-low water intake water level, a medium water intake water level, a medium-high water intake water level and a high water intake water level are set. But the common water intake water level is the medium water intake water level or the medium-high water intake water level, and the judgment according to the judgment condition b) is realized in the following manner:

judging whether the water intake water level set for the first washing drum is higher than the medium water intake water level or the medium-high water intake water level or not.

If yes, determining that the water intake quantity set for the first washing drum is greater than the common water intake quantity, if not, determining that the water intake quantity set for the first washing drum is smaller than the common water intake quantity.

According to the control method disclosed by the present disclosure, the heating time is determined by the setting of washing processes, i.e., the first washing drum corresponds to different washing processes, while the heating time of each washing process is determined to a great extent by the water intake quantity of washing water, the set value of the heating temperature and the real-time temperature difference value of washing water required to be heated in each of the washing processes. Therefore, each washing process corresponds to one of different heating times. Therefore, the maximum heating time is the heating time required when the water intake quantity is maximum, the set value of the beating temperature is maximum and the real-time temperature difference value of the washing water required to be heated is maximum in each washing process.

As shown in FIG. 1, the control method of the double-drum washing machine in the present disclosure comprises the following steps:

step S1: enabling the first washing drum to execute the heating process;

step S2: judging whether the heating temperature set for the first washing drum is higher than the normal set temperature or not;

step S3, if not, performing step S4, if yes, performing step S201;

step S4: judging whether the water intake quantity of the first washing drum is greater than the common water intake quantity or not;

step S5: if not, performing step S6; if yes, performing step S201;

step S6: judging whether a difference of a set heating temperature value and a real-time measurement value of the first washing drum is greater than that of a set heating temperature value and a real-time measurement value of die second washing drum or not;

step S7: if not, performing step S101; if yes, performing step S201;

step S101: judging whether the second washing drum performs heating or not;

step S102: if yes, judging whether the remaining heating time of the second washing, drum is greater than $T_0$ or not;

step S103: if the judgment result is yes, starting the program that the first washing drum and the second washing drum perform heating alternately, and if the judgment result is not, starting the ordered heating program that the second washing drum performs heating firstly, and then the first washing drum performs heating;

step S201: judging whether the second washing drum performs heating or not;

step S202: if yes, enabling the first washing drum to wait until the second washing drum finishes the heating process, then execute the heating process, if not, performing the next step;

step S203: judging whether the second washing drum performs dewatering or not;

step S204: if yes, enabling the first washing drum to wait until the second washing drum finishes the dewatering process, then execute the heating process, if not, performing the next step;

step S205: judging whether the second washing drum performs drying or not;

step S206: if yes, enabling the first washing drum to wait until the second washing drum finishes the drying process, then execute the heating process, if not, enabling the first washing drum to execute the heating process.

Embodiment 1

In the present disclosure, it is judged whether the heating time of the first washing drum is dose to the maximum heating time before the first washing drum heats, if the result is not, execute the following steps:

As shown in FIG. 1, the control method of the double-drum washing machine in the present disclosure comprises the following steps:

step S101: judging whether the second washing drum performs heating or not;

step S102: if yes, fudging whether the remaining heating time of the second washing drum is greater than $T_0$ or not;

step S103: if yes, execute an alternate beating program that the first washing drum and the second washing drum perform heating alternately for a period of time, if not, execute an ordered heating program that the second washing drum performs heating firstly, and then the first washing drum performs heating; and wherein $T_0$ is a time value set by a system and used for judging whether the second washing, drum is about to finish heating or not.

In the embodiment, firstly judging whether the second washing drum is in a heating state or not before the first washing drum performs heating, if the second washing drum is performing heating, the first washing drum waits for performing heating or the first washing drum and the second drum perform heating alternately according to the principle of "high power operation at different times" (i.e., the two washing drums perform high-power operation at different times, so that the instantaneous power of the double-drum washing machine can be reduced, and the stability of the double-drum washing machine can be guaranteed).

When the ordered heating program that the second washing drum performs heating firstly and then the first washing drum performs heating is selected and when the alternate heating program that the first washing drum and the second washing drum perform heating alternately is selected are determined mainly by judging whether the heating time of the second drum is about to finish or not. If the second drum is about to finish heating, the ordered heating program that the first drum performs heating after the second drum finishes heating is adopted, and if the heating time of the second drum is still very long, the second drum pauses heating, and the alternate heating program that the first drum and the second drum perform heating alternately for a period of time is adopted.

The selection and judgment manners adopted in the embodiment have the advantages that firstly, the process that the first drum waits if the second drum is about to finish heating more, which is selected, conforms to actual conditions, so that frequent controlling and switching of heated objects is avoided, and the heating efficiency is improved. Secondly, the process that the two drums perform heating alternately if the second drum still needs a certain heating time is selected, so that the heating of the first drum can be accelerated, and the phenomenon that the washing waiting time of the first drum is prolonged because, the waiting time of the first drum is overlong is avoided. Therefore, the washing processes of the two drums can be executed at the same time, and the use experience of a user is improved. And finally, the manner that only one drum executes the heating process no matter which heating process is selected conforms to the basic principle of "high power operation at different times".

The key point in the embodiment lies in how to judge whether the second drum is about to finish heating or not. Specifically, whether the second drum is about to finish heating or not can be judged by judging whether the heating time of the second drum is about to reach a preset value or whether the heating temperature of the second drum is about to reach a preset value or not. As a preferred implementation of the control method, conventional heating process setting is generally realized by setting the heating time. Therefore, whether the heating time of the second drum is about to be used out or not is judged. That is, whether the remaining heating time of the second washing drum is greater than $T_0$ or not is judged, and $T_0$ is a time value set by a system and used for judging whether the second washing drum is about to finish heating or not.

It is apparent that the specific set value of $T_0$ should be related to the total heating time of the second drum, i.e., if the total heating time of the second washing drum is $T_{m2}$, and $0<T_0\leq\frac{1}{3}T_{m2}$. Preferably, the set value of $T_0$ should be as small as possible.

The general experience value of $T_0$ can be determined according to the total washing period and the heating time of the washing machine, and preferably, $0<T_0\leq 5$ min.

In the alternate heating program in the step S103 in the embodiment, the first washing drum and the second washing drum perform heating alternately for certain time intervals. Whether the first washing drum and the second washing drum finish healing or not is judged after the heating at every time interval is finished. If the first washing dream/the second washing drum finishes heating, the second washing drum/the first washing drum performs heating all the time until the heating is finished, if not, the second washing drum and the first washing drum thither perform heating alternately.

In the alternate heating program in the embodiment, judgment is performed after each heating time interval is finished, timely adjustment is performed according to the judgment result. And if one of the drums finishes heating, the other drum can also perform heating more rapidly, so that the heating efficiency is improved.

Specifically, in the alternate heating program in step S103 of the present embodiment:

After the heating time interval of the first washing drum reaches $T_1$, it is judged whether the temperature of the first washing drum is equal to the preset temperature. If yes, the first washing drum stops heating and the second washing drum keeps beating to the preset temperature. If not, the first washing drum pauses heating and the second washing drum heats.

After the heating time interval of the second washing drum reaches $T_2$, it is judged whether the temperature of the second washing drum is equal to the preset temperature. If yes, the second washing drum stops heating and the first washing drum keeps heating to the preset temperature. If not, the second washing drum pauses heating and the first washing drum heats.

Specifically, comprises the following steps:

step S104: enabling the second washing drum to pause heating;

step S105: enabling the first washing drum to start heating;

step S106: judging whether the beating time of the first washing drum is equal to 7 or not:

step S107: if yes, performing the next step, if not, returning, to step S105;

step S108: judging whether the temperature of the first washing drum is equal to the preset temperature;

step S109: if yes, enabling the second washing drum to perform heating all the time to reach the preset temperature, and then finishing the heating stage, if not, performing the next step;

step S110: enabling the second washing drum to start heating;

step S111: judging whether the heating time of the second washing drum is equal to $T_2$ or not;

step S112: if yes, performing the next step, if not, returning to step S110;

step S113: judging whether the temperature of the second washing drum is equal to the preset temperature;

step S114: if yes, enabling the first washing drum to perform heating all the time to reach the preset temperature, and then finishing the heating stage, if not, returning to the step S104.

The first drum and the second drum in the embodiment perform heating alternately, the heating time of the first drum each time is $T_1$, the heating time of the second drum each time is $T_2$, the settings of $T_1$ and $T_2$ are also related to the total heating time $T_{1m}$ of the first drum and the total heating time $T_{m2}$ of the second drum. Which $0<T_1\leq\frac{1}{2}T_{1m}$, $0<T_2\leq\frac{1}{2}T_{m2}$, preferably, $0<T_1\leq\frac{1}{4}T_{1m}$, $0<T_1\leq\frac{1}{4}T_{m2}$.

Besides, the set values of $T_1$ and $I_2$ can be equal or unequal, if the total heating time $T_{1m}$ of the first drum differs greatly from the total heating time $T_{m2}$ of the second drum, preferably, and the set values of $T_1$ and $T_2$ are unequal. Thus, it is more beneficial for the first drum and the second drum to perform heating alternately so as to ensure that the first drum and the second drum finish heating at the same time.

As a preferred implementation in the embodiment, generally, no great difference exists in the heating time of washing machines, so that $T_1$ and $T_2$ are respective minimum time intervals when the first washing drum and the second washing drum perform heating every time, and preferably, $T_1$ is equal to $T_2$.

Specifically, the ordered heating program in the step S103 of the control method comprises the following steps:

step S115: enabling the first washing drum to wait for execution of heating;

step S116: judging whether the second washing drum finishes heating or not;

step S117: if yes, performing the next step, if not, returning to step S115;

step S118: enabling the first washing drum to start heating;

step S119: judging whether the first washing drum finishes heating or not;

step S120: if yes, finishing the heating stage, if not, returning, to step S118.

Further, the method for judging whether the second washing drum and the first washing drum finish heating or not in the step S116 and the step S119 is realized by judging whether the heating temperatures of the second washing drum and the first washing drum reach the preset heating temperature values or not. And if the heating temperatures of the second washing drum and the first washing drum reach the preset heating temperature values, the second washing drum and the first washing drum finish heating, if not, the heating is not finished.

In the embodiment, the heating temperatures of both the ordered heating program and the alternate heating program are judged in the heating process to judge whether the heating temperature reaches the preset heating temperature or not. So that a first temperature sensor and a second temperature sensor which are used for monitoring temperatures are arranged in the first drum and the second drum of the double-drum washing machine provided by the present disclosure.

Before the first drum in the embodiment performs heating, not only is whether the second drum performs heating or not judged, but also whether the second drum executes other high-power processes or not needs to be judged if the second drum does not perform heating, so that the principle of "high power operation at different times" is met.

Specifically, if the judgment result in the step S102 is no, the following steps are performed:

step S121: judging whether the second washing drum performs dewatering or not;

step S122: if yes, performing the next step;

step S123: enabling the first washing drum to wait for execution of heating;

step S124: judging whether the second washing drum finishes dewatering or not; and step S125: if yes, performing the next step, if not, returning to step S123;

step S126: enabling the first washing drum to start heating;

step S127: judging whether the first washing drum finishes heating or not; and step S128: if yes, finishing the heating stage, if not, returning to step S126.

In control method in the embodiment, if the second drum is judged not to perform heating when the first drum performs heating, whether the second drum performs dewatering or not is further judged. If the second drum performs dewatering, and the first drum waits for executing the heating process until the second drum finishes dewatering, and then executes the heating process. So that the phenomenon that the heating effect or the dewatering effect of the washing machine is affected by over high power of the washing machine because the second drum performs dewatering while the first drum performs heating is avoided.

Further, if the judgment result in the step S122 is no, the following steps are performed:

step S129: judging whether the second washing drum performs drying or not;

step S130: if yes, performing the next step, if not, enabling the first washing drum to perform heating until the heating process is finished;

step S131; enabling the first washing drum to wait for execution of heating;

step S132: judging whether the second washing drum finishes drying or not;

step S133: if yes, performing the next step, if not, returning to step S131;

step S134; enabling the first washing drum to start heating;

step S135: judging whether the first washing drum finishes heating or not; and step S136: if yes, finishing, the heating process, or else, returning to step S134.

The influence of the drying process on the power is also taken into account in the control method in the embodiment. When the first drum performs heating, the second drum is determined not to perform high-power processes such as heating and dewatering. Further, whether the second drum executes the drying process or not is judged. If the second drum performs drying, the first drum waits heating and starts to perform heating after the second drum finishes drying. So the phenomenon that two high-power heating and drying processes are executed at the same time is further avoided.

In conclusion, the control method in the embodiment takes both cases that whether the second drum performs heating or not and whether the second drum performs dewatering and drying or not into account before the first drum performs heating, and therefore, various high-power factors are comprehensively considered, the control method is more comprehensive, and the stability and the service life of the double-drum washing drum are guaranteed.

Embodiment 2

Figure 2:
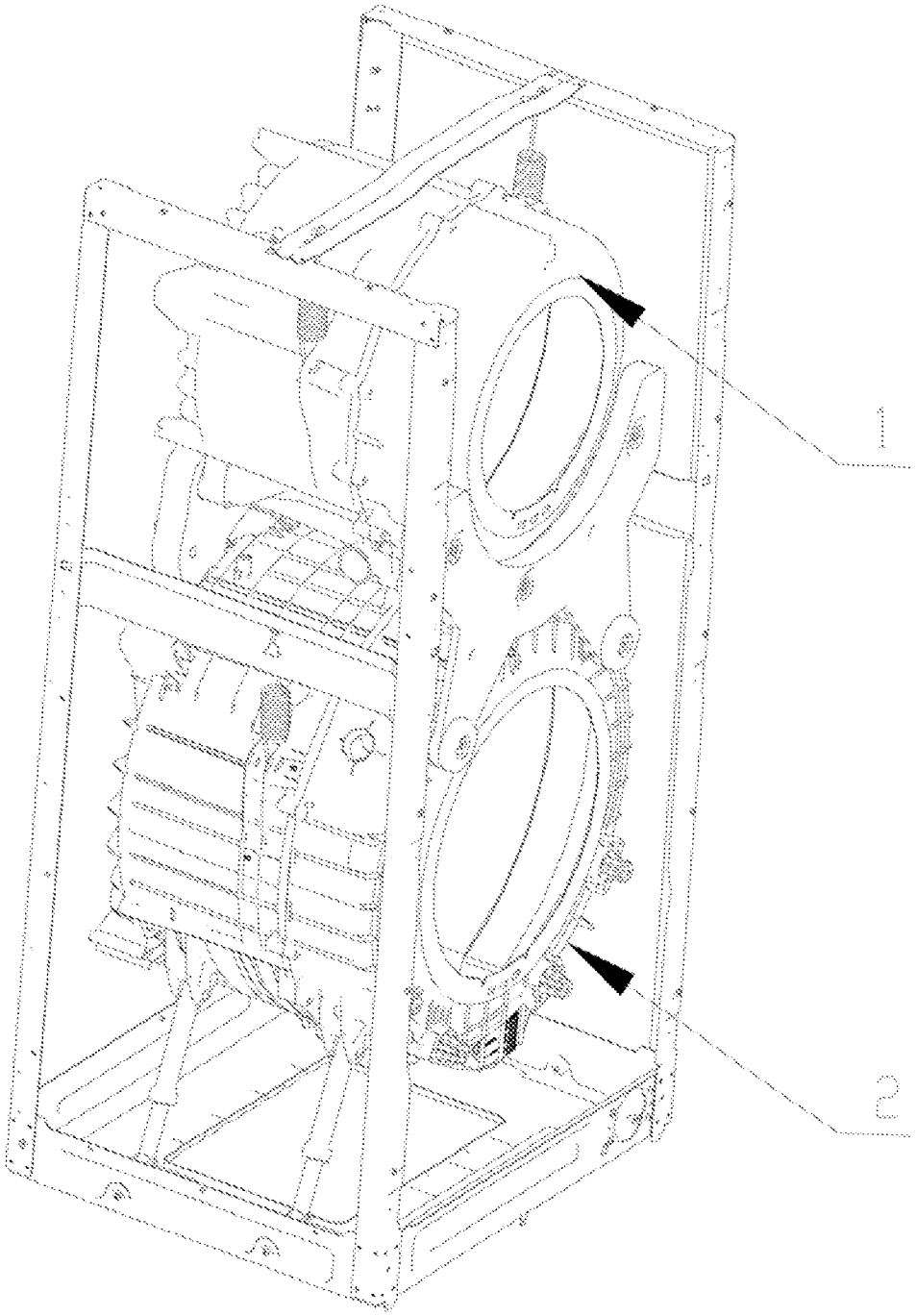
FIG. 2 is a schematic structural diagram of a double-drum washing machine of the present disclosure.

As shown in FIG. 2, a double-drum washing machine of the present embodiment is provided with a first washing drum 1 and a second washing drum 2 which are capable of independently performing a clothes washing step. Any one of the first washing drum 1 and the second washing drum 2 can independently execute a washing process, a rinsing process, a dewatering process on clothes sequentially, so that the purpose of washing the clothes is achieved.

The first washing drum 1 and the second washing drum 2 of the double-drum washing machine of the present disclosure are respectively provided with heating means, in order to beat the washing water of the first washing drum 1 and the second washing drum 2 respectively to enhance the washing effect.

Further, each of the first washing drum 1 and the second washing drum 2 of the present embodiment can also be additionally provided with a drying means for executing a drying process after executing the dewatering process, so that the purpose of drying the clothes in the first washing drum 1 and/or the second washing drum 2 is achieved.

Embodiment 3

Figure 3:
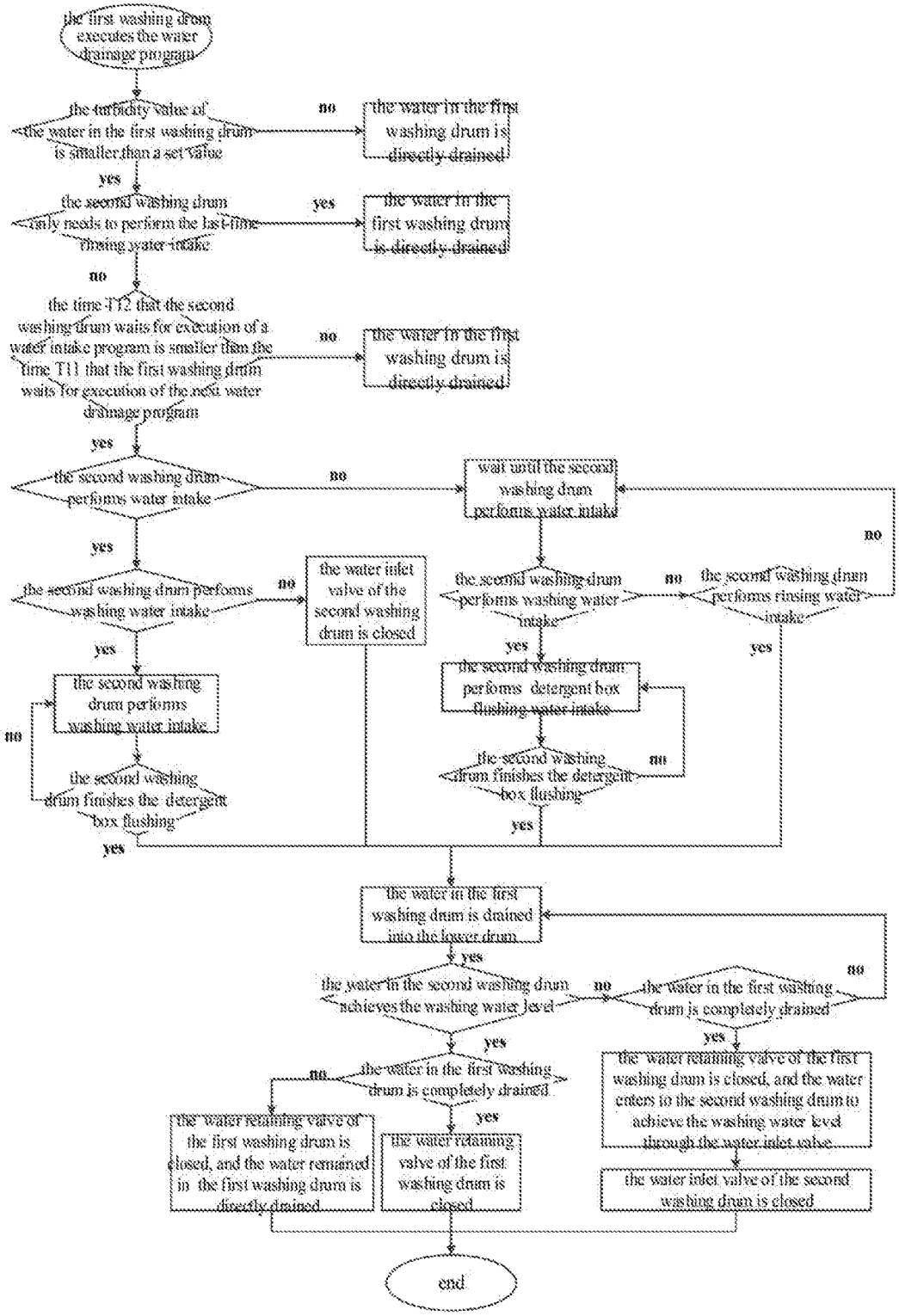
FIG. 3 is a flow block diagram of embodiment 3 of the present disclosure.

As shown in FIG. 3, the present embodiment uses the drainage waiting time as a criterion to determine whether or not to reuse the water. According to the drainage waiting time, it is determined whether or not to wait for the water to be discharged to another drum for reuse when the drainage process is reached. It has a simple determination and control logic and has higher control stability in an actual washing process. And it makes full reuse of washing water and has a high practical value and is more effective to promote the application.

When the first washing machine and the second washing machine are both operating at the same time, the water reuse control method is as follows:

A water reuse control method of a multi-drum washing machine is provided. The multi-drum washing machine at least comprises a first washing drum and a second washing drum, when the first washing drum and the second washing drum are operating at the same time and when the first washing drum reaches a drainage process, it is compared a time $T_{12}$ for reaching a water supply process of the second washing drum and a time $T_{11}$ for reaching a next drainage process of the first washing drum. If $T_{12}<T_{11}$, the first washing drum waits until the second washing drum supplies water. If $T_{12}\geq T_{11}$, the water in the first washing drum is drained directly.

It is determined whether or not the water in the first washing drum can be reused before comparing the time $T_{12}$ for reaching the water supply process of the second washing drum and the time $T_{11}$ for reaching the next drainage process of the first washing drum. If no, the water in the first washing drum is drained directly. If yes, it is compared the time $T_{12}$ for reaching the water supply process of the second washing drum and the time $T_{11}$ for reaching the next drainage process of the first washing drum.

Or, it is determined whether or not the water in the first washing drum can be reused when the first washing drum waits until the start of the water supply process of the second washing drum. If no, the water in the first washing drum is drained directly. If yes, the water in the first washing drum is drained into the second washing drum for reuse.

Specifically, it comprises step 1: when the first washing drum reaches the drainage process, it is determined whether or not the water in the first washing drum can be reused, if yes, execute step 2, if no, the water in the first washing drum is drained directly;

step 2: it is compared a time $T_{12}$ for reaching a water supply process of the second washing drum and a time $T_{11}$ for reaching a next drainage process of the first washing drum. If $T_{12}<T_{11}$, the first washing drum waits until a start of water supply process of the second washing drum and the water in the first washing drum is drained into the second washing drum to reuse. If $T_{12}\geq T_{11}$, the water in the first washing drum is drained directly. By adding the process of the determination of whether or not to wait, to a large extent it increases the water reuse probability of the first washing drum, and more water can be reused.

In step 1, if the second washing drum is supplying water when the first washing drum reaches the drainage process, the time $T_{12}$ for reaching the water supply process of the second washing drum is 0, and no need to wait. The water in the first washing drum is drained into the second washing drum for reuse. It is also possible to first determine whether or not the second washing drum is currently executing the water supply process before comparing the time $T_{12}$ for reaching the water supply process of the second washing drum and the time $T_{11}$ for reaching a next drainage process of the first washing drum. If the second washing drum is not subjected to the water supply process, then it is compared the time $T_{12}$ for reaching the water supply process of the second washing drum and the time $T_{11}$ for reaching a next drainage process of the first washing drum.

In step 2, an allowable waiting time $T_1$ is set, which $T_1<T_{11}$. If $T_{12}<T_1$, the first washing drum waits until the second washing drum supplies water and the water in the first washing drum is drained into the second washing drum for reuse. If $T_{12}\geq T_1$, the water in the first washing drum is drained directly. This step can avoid the first washing drum waiting too long and reasonably arrange the water reuse under the premise of ensuring the washing time of the first washing drum. Thus, it will not waste too much time of the first washing drum because of only considering water reuse. If the washing machine determines that the waiting time is too long and exceeds the set allowable waiting time, the water in the first washing drum is not reused. The determination makes the reuse of water more reasonable, optimizing the relationship between waiting time and water reuse to a large extent.

In step 1, the turbidity value or the bubble concentration value of the water in the first washing drum is detected. If the turbidity value or the bubble concentration value of the water is smaller than the set value, the water in the first washing drum can be reused. Otherwise the water in the first washing drum cannot be reused and is drained away directly. Water can be reused when the turbidity value or bubble concentration value of the water is within the set range.

In step 1, when the first washing drum reaches the drainage process, it is determined whether or not the process of which the second washing drum is in progress or is about to be performed is a water supply for a last rinse. If yes, the water in the first washing drum is drained directly. If no, it is continued to be determined whether or not the water in the first washing drum can be reused. Thus to ensure that the water supplied in the last rinse process is clean water, which ensures that the effect of washing clothes after washing.

In step 2, before the water in the first washing drum is drained into the second washing drum, it is determined whether or not the second washing drum executes the water supply process for washing. If yes, the second washing drum first supplies water for washing the detergent box. After the completion of water supply for washing the detergent box of the second washing drum, the water in the first washing drum is drained into the second washing drum. If no, the water in the first washing drum is drained into the second washing drum directly.

In step 2, when the water in the first washing drum is drained into the second washing drum, the height of the water level in the second washing drum is detected. If the water level in the second washing drum reaches the set water level value and there is water in the first washing drum, the remaining water of the first washing drum is discharged directly. If the water in the first washing drum is entirely drained into the second washing drum and the water level in the second washing drum does not reach the set water level value, then the second washing drum supplies clean water through an external water inlet.

When the water in the first washing drum is drained away directly, it is determined whether or not the second washing drum is executing the dewatering process. If yes, the first washing drum waits until the dewatering process of the second washing drum is completed, and then drains. If no, it is determined a time $T_{32}$ for reaching the dewatering process of the second washing drum, a time $T_{33}$ taken for the second washing drum to dewater, and an allowable waiting time $T_3$ is set. If $T_{32}+T_{33}<T_3$, the first washing drum waits until the dewatering process of the second washing drum is completed, and then drains. Otherwise, the water in the first washing drum is drained directly It is also possible to determine whether or not the water in the first washing drum can be reused by determining the washing state and the washing times. In step 1, the water in the first washing drum cannot be reused, if the first washing drum is in a washing process when it drains and the second washing drum is in a rinse process when it supplies water; or if the first washing drum and the second washing drum are both in the washing process when the first washing drum drains and the second washing drum supplies water, and washing times of the first washing drum is less than washing times of the second washing drum; or if the first washing drum and the second washing drum are both in the rinse process when the first washing drum drains and the second washing drum supplies water, and rinsing times of the first washing drum is less than rinsing times of the second washing drum.

When the second washing drum reaches the drainage process, it is determined whether or not the water in the second washing drum can be reused. If yes, comparing the time for reaching the water supply process of the first washing drum and the time for reaching the next drainage process of the second washing drum, it is determined whether or not the second washing drum waits until the first washing drum executes the water supply process.

The drainage outlet of the first washing drum is communicated with the second washing drum, and the water in the first washing rum can be drained into the second washing drum to reuse. The drainage outlet of the first washing drum is provided with a holding valve, the water in the first washing drum can flow through the holding valve into the second washing drum. The second washing drum is provided with an inlet valve and the clean water can flow into the second washing drum through the inlet valve. The control method is as follows:

1) The first washing drum reaches the drainage process,

2) It is determined whether or not the water in the first washing drum can be reused, if yes, execute step 3), if no, execute step 6), 3) it is determined a time $T_{11}$ for reaching a next drainage process of the first washing drum, and a time $T_{12}$ for reaching a water supply process of the second washing drum, if $T_{12}<T_{11}$, execute step 4), if $T_{12}\geq T_{11}$, execute step 6), 4) The first washing drum waits until the second washing drum supplies water, execute step 5), 5) The water in the first washing drum is drained into the second washing drum, 6) The water in the first washing drum is drained away directly.

The control method can also add a process of determining whether or not the second washing drum is supplying water before comparing the time for reaching the next drainage process of the first washing drum and the time for reaching executing the water supply process of the second washing drum. The control method is as follows:

1) The first washing drum reaches the drainage process,

2) It is determined whether or not the water in the first washing drum can be reused, if yes, execute step 3), if no, execute step 7), 3) it is determined whether or not the second washing drum is executing the water supply process, if no, execute step 4), if yes, execute step 6), 4) It is determined a time $T_{11}$ for reaching a next drainage process of the first washing drum, a time $T_{12}$ for reaching a water supply process of the second washing drum, if $T_{12}<T_{11}$, execute step 5), if $T_{12}\geq T_{11}$, execute step 7), 5) The first washing drum waits until the second washing drum supplies water, execute step 6), 6) The water in the first washing drum is drained into the second washing drum, 7) The water in the first washing drum is drained away directly.

The control method may also include determining whether or not the first washing drum have enough time to wait the second washing drum supplying water, the control method is as follows:

1) The first washing drum reaches the drainage process,

2) It is determined whether or not the water in the first washing drum can be reused, if yes, execute step 3), if no, execute step 8), 3) It is determined whether or not the second washing drum is executing the water supply process, if no, execute step 4), if yes, execute step 7), 4) It is determined a time $T_{11}$ for reaching a next drainage process of the first washing drum, a time $T_{12}$ for reaching a water supply process of the second washing drum, if $T_{12}<T_{11}$, execute step 5), if $T_{12}\geq T_{11}$, execute step 8), 5) Set an allowable waiting time $T_1$, if $T_{12}<T_1$, execute step 6), if $T_{12}\geq T_1$, execute step 8), 6) The first washing drum waits until the second washing drum supplies water, execute step 7), 7) The water in the first washing drum is drained into the second washing drum, 8) The water in the first washing drum is drained away directly.

If the water in the first washing drum is too dirty or water supply process of the second washing drum is for the last rinse, the water in the first washing drum cannot be reused as well. The control method is as follows:

1) The first washing drum reaches the drainage process,

2) The turbidity value or the bubble concentration value of the water in the first washing drum is detected to determine whether or not the turbidity value or the bubble concentration value is smaller than the set value, If yes, execute step 3), if no, execute step 9), 3) It is determined whether or not the second washing drum has only the last rinse left, if no, execute step 4), if yes, execute step 9), 4) It is determined whether or not the second washing drum is executing water supply process, if no, execute step 5), if yes, execute step 8), 5) It is determined a time $T_{11}$ for reaching a next drainage process of the first washing drum, a time $T_{12}$ for reaching a water supply process of the second washing drum, if $T_{12}<T_{11}$, execute step 6), if $T_{12}\geq T_{11}$, execute step 9), 6) Set an allowable waiting time $T_1$, if $T_{12}<T_1$, execute step 7), if $T_{12}\geq T_1$, execute step 9), 7) The first washing drum waits until the second washing drum supplies water, execute step 8), 8) The water in the first washing drum is drained into the second washing drum, 9) The water in the first washing drum is drained away directly.

When the water in the first washing drum is drained into the second washing drum and if the water supply of the second washing drum is for washing, the detergent box need to be washed and water level need to be detected. The control method is as follows:

1) The first washing drum reaches the drainage process,

2) The turbidity value or the bubble concentration value of the water in the first washing drum is detected to determine whether or not the turbidity value or the bubble concentration value is smaller than the set value. If yes, execute step 3), if no, execute step 12), 3) It is determined whether or not the second washing drum has only the last rinse left, if no, execute step 4), if yes, execute step 12), 4) It is determined whether or not the second washing drum is executing water supply process, if no, execute step 5), if yes, execute step 10), 5) It is determined a time $T_{11}$ for reaching a next drainage process of the first washing drum, a time $T_{12}$ for reaching a water supply process of the second washing drum, if $T_{12}<T_{11}$, execute step 6), if $T_{12}\geq T_{11}$, execute step 12), 6) Set an allowable waiting time $T_1$, if $T_{12}<T_1$, execute step 7), if $T_{12}\geq T_1$, execute step 12), 7) It is determined whether or not the second washing drum is executing the water supply process for washing, if yes, execute step 8), if no, execute step 10), 8) The second washing drum first supplies water for washing the detergent box, after the completion of water supply for washing the detergent box of the second washing drum, execute step 9), 9) The first washing drum waits until the second washing drum supplies water, execute step 10), 10) The water in the first washing drum is drained into the second washing drum, 11) Detect the height of the water level in the second washing drum. When the water level in the second washing drum reaches the set water level value and if there is still water left in the first washing drum, the left water is drained away directly. If the water level in the second washing drum still not reaches the set water level value after the water in the first washing drum is entirely drained into the second washing drum, clean water is flooded into the second washing drum.

12) The water in the first washing drum is drained away directly.

The first washing drum and the second washing drum of the present embodiment are only for the sake of convenience of the description, regardless of the order of the relationship. It may also reuse the water in the second washing drum, the drainage outlet of the second washing drum is communicated with the first washing drum. The water in the second washing drum can be drained into the first washing drum for reuse. The drainage outlet of the second washing drum is provided with a holding valve and the water, in the second washing drum can flow into the first washing drum through the holding valve. The first washing drum is provided with an inlet valve, clean water from outside can flow into the first washing drum through the inlet valve. When one washing drum reaches the drainage process, it is determined whether or not, the water of the washing drum is drained into the other washing drum for reuse. And when the other washing drum reaches the drainage process, it doesn't need to consider the water reuse of the other washing drum. It avoids causing an infinite loop of both washing drums waiting.

The specific control method is the same as above, except that the number of the first washing drum and the second washing drum is exchanged, and no longer mentioned.

Embodiment 4

Figure 4:
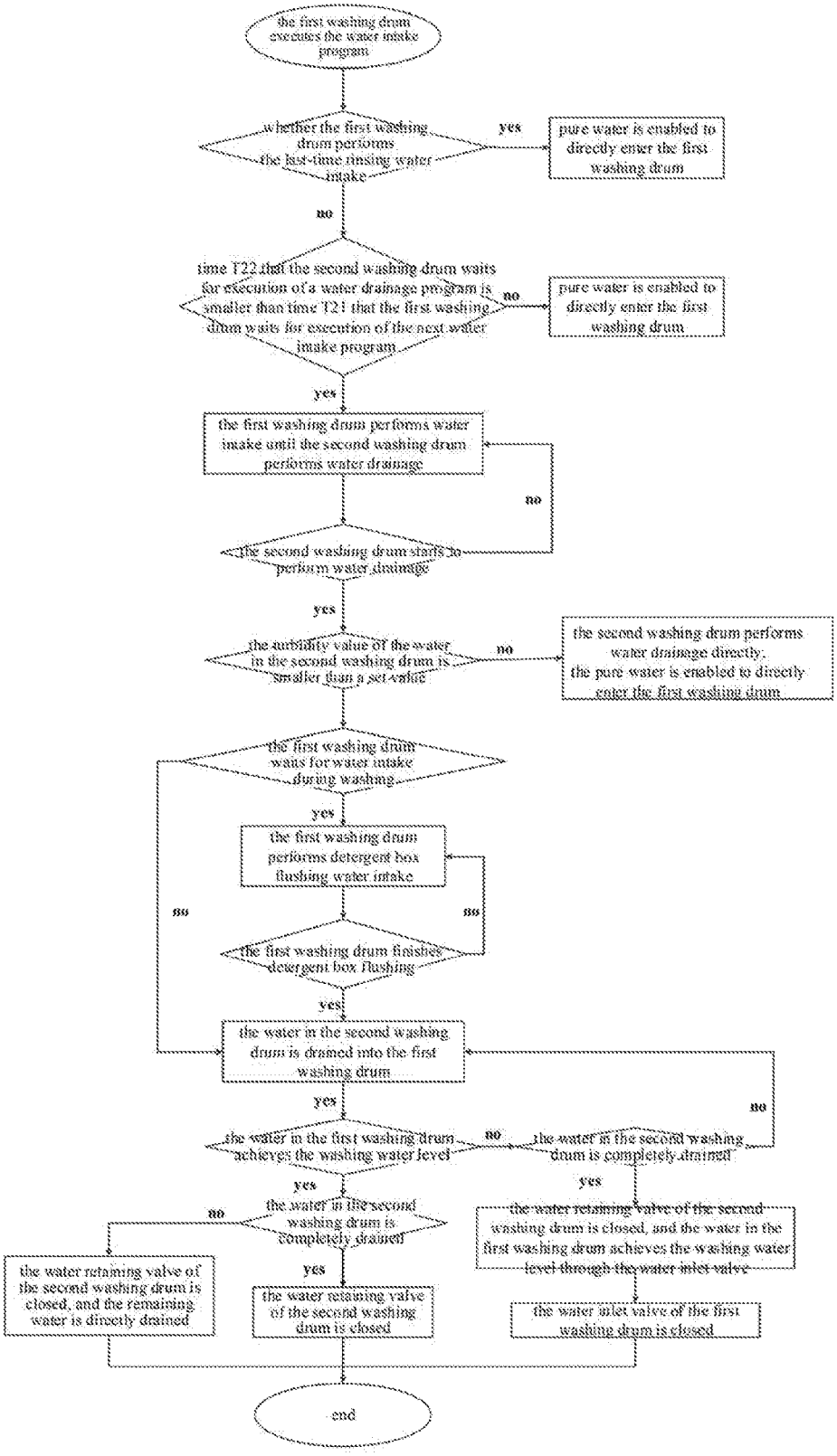
FIG. 4 is a flow block diagram of embodiment 4 of the present disclosure.

As shown in FIG. 4, the present embodiment uses the waiting time of the water supply as criterion to determine whether or not to reuse the water. According to the waiting time of water supply, it is determined whether to reuse water drained from the other washing drum when one washing drum reaches the water supply process. The method has a simple judgment and control logic; the control stability is high in the actual washing process. At the same time, it achieves a full reuse of water, and the practical value is high, which is more effective to promote and apply.

When the first washing drum and the second washing drum are both in the working state at the same time, the water reuse control method is as follows:

A water reuse control method of a multi-drum washing machine is provided, and the multi-drum washing machine at least comprises a first washing drum and a second washing drum. When the first washing drum and the second washing drum are both in the working state at the same time, the water reuse control method is as follows: when the first washing drum reaches the water supply process, it is compared a time $T_{22}$ for reaching a drainage process of the second washing drum and a time $T_{21}$ for reaching a next water supply process of the first washing drum. If $T_{22} \geq T_{21}$, the first washing drum supplies clean water directly. If $T_{22} < T_{21}$, the first washing drum waits until a start of the drainage process of the second washing drum.

It is determined whether or not the water in the second washing drum can be reused before comparing the time $T_{22}$ for reaching the drainage process of the second washing drum and the time $T_{21}$ for reaching the next water supply process of the first washing drum. If no, the water in the first washing drum supplies clean water directly. If yes, it is compared the time $T_{22}$ for reaching the drainage process of the second washing drum and the time $T_{21}$ for reaching the next water supply process of the first washing drum. Or, it is determined whether or not the water in the second washing drum can be reused when the first washing drum waits until the start of, the drainage process of the second washing drum. If no, the first washing drum supplies clean water directly. If yes, the water in the second washing drum is drained into the first washing drum for reuse.

Specific;

step 1: when the first washing drum reaches the water supply process, it is compared the lime $T_{22}$ for reaching the drainage process of the second washing drum and the time $T_{21}$ for reaching the next water supply process of the first washing drum. If $T_{22} \geq T_{21}$, the first washing drum supplies clean water directly. If $T_{22} < T_{21}$, the first washing drum waits until a start of the drainage process of the second washing drum, execute step 2;

Step 2: it is determined whether or not the water in the second washing drum can be reused. If yes, the water in the second washing drum is drained into the first washing drum to reuse, if no, the first washing drum supplies clean water directly. By adding the process of the determination of whether or not to wait, to a large extent it increases the water reuse probability of the second washing drum, and more water can be reused.

In step 1, if the second washing drum is draining water when the first washing drum reaches the water supply process, the time $T_{22}$ for reaching the drainage process of the second washing drum is 0, and no need to wait, and directly executes step 2. It is also possible to first determine whether or not the second washing drum is currently executing the drainage process before comparing the time $T_{22}$ for reaching the drainage process of the second washing drum and the time $T_{21}$ for reaching the next water supply process of the first washing drum. If the second washing drum is not subjected to the drainage process, then it is compared the time $T_{22}$ for reaching the drainage process of the second washing drum and the time $T_{21}$ for reaching the next water supply process of the first washing drum.

In step 1, an allowable waiting time $T_2$ is set, which $T_2 < T_{21}$. If $T_{22} < T_2$, the first washing drum waits until the second washing drum drains, and executes step 2. If $T_{22} \geq T_2$, the first washing drum supplies clean water directly. This step can avoid the first washing drum waiting too long and reasonably arrange the water reuse tinder the premise of ensuring the washing time of the first washing drum. Thus, it will not waste too much time of the first washing drum because of only considering water reuse. If the washing machine determines that the waiting time is too long and exceeds the set allowable waiting time, the first washing drum will not reuse the water in the second washing drum. The determination makes the reuse of water more reasonable, optimizing the relationship between waiting time and water reuse to a large extent.

In step 2, the turbidity value or the bubble concentration value of the water in the second washing drum is detected. If the turbidity value or the bubble concentration value of the water is smaller than the set value, the water in the second, washing drum can be reused. Otherwise the water in the second washing drum cannot be reused. Water can be reused when the turbidity value or bubble concentration value of the water is within the set range.

In step 1, when the first washing drum reaches the water supply process, it is determined whether or not the water supply process being executed is a water supply for a last rinse. If yes, the first washing drum supplies clean water directly. If no, it is continued to compare the time $T_{22}$ for reaching the drainage process of the second washing drum and the time $T_{21}$ for reaching the next water supply process of the first washing drum. Thus it is ensured that the water supplied-in in the last rinse process is clean water, which ensures that the effect of washing clothes after washing.

In step 2, when the water in the second washing drum is drained into the first washing drum, it is determined whether or not the first washing drum executes the water supply process for washing. If yes, the first washing drum first supplies water for washing the detergent box. After the completion of water supply for washing the detergent box of the first washing drum, the water in the second washing drum is drained into the first washing drum. If no, the water in the second washing drum is drained into the first washing drum directly.

In step 2, when the water in the second washing drum is drained into the first washing drum, the height of the water level in the first washing drum is detected. If the water level in the first washing drum reaches the set water level value and there is water in the second washing drum, the remaining water in the second washing tub is discharged directly. If the water in the second washing drum is entirely drained into the first washing drum and the water level in the first washing tub does not reach the set water level value, then the first washing drum supplies clean water.

When the water in the second washing drum is drained away directly, it is determined whether or not the first washing drum is executing the dewatering process. If yes, the second washing drum waits until the dewatering process of the first washing drum is completed, and then drains. If no, it is determined a time for reaching the dewatering process of the first washing drum is $T_{41}$, a time taken for the first washing drum to dewater is $T_{44}$, and an allowable waiting time $T_4$ is set. If $T_{41}+T_{44}<T_4$, the second washing drum waits until the dewatering process of the first washing drum is completed, and then drains. Otherwise, the water of the second washing drum is drained directly.

It is also possible to determine whether or not, the water in the first washing drum can be reused by determining the washing state and the washing times. In step 2, the water in the first washing drum cannot be reused, if the second washing drum is in a washing process when it drains and the first washing drum is in a rinse process when it supplies water; or if the first, second washing drums are both in the washing process when the second washing drum drains and the first washing drum supplies water, and washing times of the second washing drum is less than washing times of the first washing drum; or if the first, second washing drums are both in the rinse process when the second washing drum drains and the first washing drum supplies water, and rinsing times of the second washing drum is less than rinsing times of the first washing drum.

When the second washing drum reaches the water supply process, it is compared the time for reaching the drainage process of the first washing drum and the time for reaching the next water supply of the second washing drum, and it is determined whether or not the second washing drum waits until the first washing drum drains.

The drainage outlet of the second washing drum is communicated with the first washing drum, and the water in the second washing drum can be drained into the first washing drum to reuse. The drainage outlet of the second washing drum is provided with a holding valve, the water in the second washing drum can flow through the holding valve into the first washing drum. The first washing drum is provided with an inlet valve and the clean water can flow into the first washing drum through the inlet valve. The control method is as follows:

1) The first washing drum reaches the water supply process,

2) It is determined whether or not the water in the second washing drum can be reused, if yes, execute step 3), if no, execute step 6), 3) It is determined a time $T_{21}$ for reaching a next water supply process of the first washing drum, a time $T_{22}$ for reaching a drainage prose of the second washing drum, if $T_{22}<T_{21}$, execute step 4), if $T_{22}\geq T_{21}$, execute step 6), 4) The first washing drum waits until the second washing drum drains, execute step 5), 5) The water in the second washing drum is drained into the first washing drum, 6) The first washing drum supplies clean water directly and the water in the second washing drum is drained away directly.

The control method can also add a process of determining whether or not the second washing drum is draining water before comparing the time $T_{22}$ for reaching the drainage process of the second washing drum and the time $T_{21}$ for reaching the next water supply process of the first washing drum. The control method is as follows:

1) The first washing drum reaches the water supply process,

2) It is determined whether or not the water in the second washing drum can be reused, if yes, execute step 3), if no, execute step 7), 3) It is determined whether or not the second washing drum as executing the drainage process, if no, execute step 4), if yes, execute step 6), 4) It is determined a time $T_{21}$ for reaching a next water supply process of the first washing drum, a time $T_{22}$ for reaching a drainage process of the second washing drum, if $T_{22}<T_{21}$, execute step 5), if $T_{22}\geq T_{21}$, execute step 7), 5) The first washing drum waits until the second washing drum drains, executes step 6), 6) The water in the second washing drum is drained into the first washing drum, 7) The first washing drum supplies clean water directly and the water in the second washing drum is drained away directly.

The control method may also include determining whether or not the first washing drum has enough time to wait the second washing drum draining, the control method is as follows:

1) The first washing drum reaches the water supply process,

2) It determined whether or not the water in the second washing drum can be reused, if yes, execute step 3), if no, execute step 8), 3) It is determined whether or not the second washing drum is executing the drainage process, if no, execute step 4), if yes, execute step 7), 4) It is determined a time $T_{21}$ for reaching a next water supply process of the first washing drum, a time $T_{22}$ for reaching a drainage process of the second washing drum, if $T_{22}<T_{21}$, execute step 5), if $T_{22}\geq T_{21}$, execute step 8), 5) an allowable waiting time $T_2$ is set, if $T_{22}<T_2$, execute step 6), if $T_{22}\geq T_2$, execute step 8), 6) The first washing drum waits until the second washing drum drains, execute step 7), 7) The water in the second washing drum is drained into the first washing drum, 8) The first washing drum supplies clean water directly and the water in the second washing drum is drained away directly.

1) The first washing drum reaches the water supply process,

2) It is determined whether or not the first washing drum has only the last rinse left, if no, execute step 3), if yes, execute step 9), 3) It is determined whether or not the second washing drum is executing drainage process, if no, execute step 4), if yes, execute step 7), 4) It is determined a time $T_{21}$ for reaching a next water supply process of the first washing drum, a time $T_{22}$ for reaching a drainage process of the second washing drum, if $T_{22}<T_{21}$, execute step 5), if $T_{22}\geq T_{21}$, execute step 9), 5) an allowable waiting time $T_2$ is set, if $T_{22}<T_2$, execute step 6), if $T_{22}\geq T_2$, execute step 9), 6) The first washing drum waits until the second washing drum supplies water, execute step 7), 7) The turbidity value or the bubble concentration value of the water in the second washing drum is detected to determine whether or not the turbidity value or the bubble concentration value is smaller than the set value, if yes, execute step 8), if no, execute step 9), 8) The water in the second washing drum is drained into the first washing drum, 9) The first washing drum supplies clean water directly and the water in the second washing drum is drained away directly.

When the water in the second washing drum is drained into the first washing drum and if the water supply of the first washing drum is for washing, the detergent box need to be washed and water level need to be detected. The control method is as follows:

1) The first washing drum reaches the water supply process,

2) It is determined whether or not the first washing drum has only the last rinse left, if no, execute step 3), if yes, execute step 12), 3) It is determined whether or not the second washing drum is executing drainage process, if no, execute step 4), if yes, execute step 7).

4) It is determined a time $T_{21}$ for reaching a next water supply process of the first washing drum, a time $T_{22}$ for reaching a drainage process of the second washing drum, if $T_{22}<T_{21}$, execute step 5), if $T_{22}\geq T_{21}$, execute step 12), 5) An allowable waiting time $T_2$ is set, if $T_{22}<T_2$, execute step 6), if $T_{22}\geq T_2$, execute step 12), 6) The first washing drum waits until the second washing drum drains water, execute step 7), 7) The turbidity value or the bubble concentration value of the water in the second washing drum is detected to determine whether or not the turbidity value or the bubble concentration value is smaller than the set value, if yes, execute step 8), if no, execute step 12), 8) It is determined whether or not the first washing drum is executing the water supply process for washing, if yes, execute step 9), if no, execute step 10), 9) The first washing drum first supplies water for washing the detergent box, after the completion of water supply for washing the detergent box of the first washing drum, execute step 10), 10) The water in the second washing drum is drained into the first washing drum, 11) It is detected the height of the water level in the first washing drum. When the water level in the first washing drum reaches the set water level value and if there is still water left in the second washing drum, the left water is drained away directly. If the water level in the first washing drum still not reaches the set water level value after the water in the second washing drum is entirely drained into the first washing drum, water from outside is flooded into the first washing drum through the water inlet.

12) The first washing drum supplies clean water directly and the water in the second washing drum is drained away directly.

The first washing drum and the second washing drum of the present embodiment are only for the sake of convenience of the description, regardless of the order of the relationship. It may also to reuse the water in the first washing drum, the water inlet of the second washing drum is communicated with the drainage outlet of the first washing drum. The water in the first washing drum can be drained into the second washing drum for reuse. The drainage outlet of the first washing drum is provided with a holding valve and the water of the first washing drum can flow into the second washing drum through the holding valve. The second washing drum is provided with an inlet valve, clean water from outside can flow into the second washing drum through the inlet valve. When one washing drum reaches the water supply process, it is determined whether or not the water in the other washing drum is drained into the washing drum for reuse. And when the other washing drum reaches the water supply process, it doesn't need to consider the water reuse of the washing drum. It avoids causing an infinite loop of both washing drums waiting.

The specific control method is the same as above, except that the number of the first washing drum and the second washing drum is exchanged, and no longer mentioned.

Embodiment 5

Figure 5:
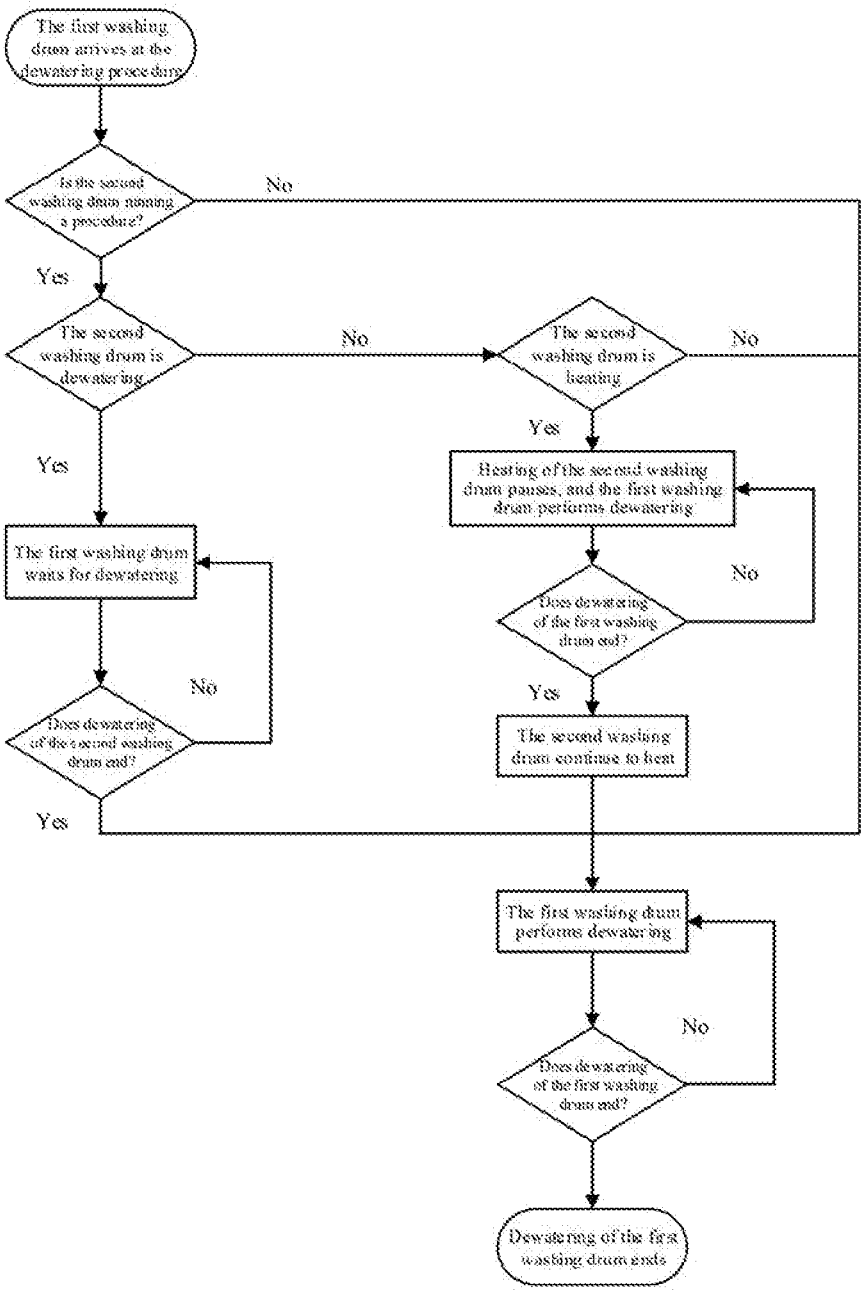
FIG. 5 is a flow block diagram of embodiment 5 of the present disclosure.

As shown in FIG. 5, the embodiment is a dewatering control procedure of a control method of a double-drum washing machine of the present disclosure, mainly for achieving controlling of the dewatering procedure, and specifically including the following step 1) before the first washing drum performs dewatering;

2) determining whether the second washing drum is running a procedure;

3) if the determination result is yes, executing step 4), and if the determination result is no, the first washing drum performing dewatering;

4) determining whether the second washing drum is dewatering;

5) if the determination result is yes, executing step 6), and if the determination result is no, executing step 7);

6) the first washing drum waiting until the second washing drum finishes dewatering, then dewatering;

7) determining whether the second washing drum is heating;

8) if the determination result is yes, executing step 9), and if the determination result is no, the first washing drum performing dewatering;

9) the second washing drum pausing beating, and the first washing drum performing dewatering;

10) determining whether dewatering of the first washing drum ends;

11) if the determination result is yes, the second washing drum finishing heating, and if the determination result is no, executing step 9).

The high power procedure control system of the embodiment achieves controlling of the dewatering procedure. As the dewatering procedure of the washing machine takes shorter time than any other procedures, the embodiment follows the principle of dewatering procedure precedence: when the first washing drum is to about perform the dewatering procedure, if the second washing drum is performing the dewatering procedure, the first washing drum dewaters after the second washing drum finishes dewatering. And if the second washing drum is performing high power procedure such as heating procedure or drying procedure, other high power procedure, such as the heating or drying procedure being performed by the second washing drum is paused. And then the second washing drum continues performing other high power procedure such as the beating or drying procedure after the first washing drum preferentially performs the dewatering procedure.

Thus, the dewatering control procedure of the embodiment has the following beneficial effects:

1) It avoids the two or more drums perform the dewatering procedure simultaneously to cause larger resonance, produce greater noise and seriously influence the user's experience of use, the larger resonance also leading to some damage to the washing machine.

2) It can avoid multiple drums perform high power procedures simultaneously, prevents loss caused by a very high power of the washing machine, and ensures the stability and, service life of the washing machine.

Embodiment 6

Figure 6:
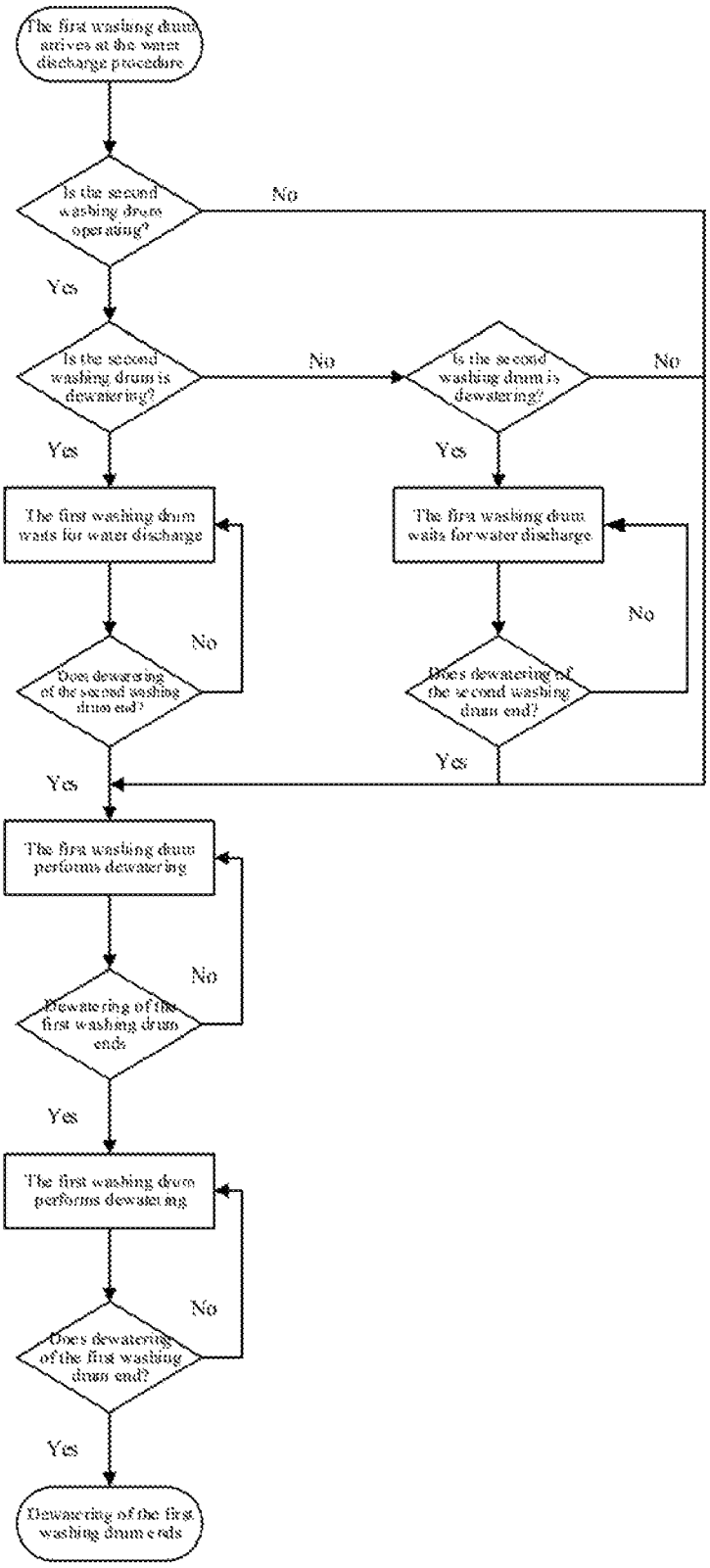
FIG. 6 is a flow block diagram of embodiment 6 of the present disclosure.

As shown in FIG. 6, the embodiment is a water drainage control procedure of a control method of a double-drum washing machine of the present disclosure, specifically including the following steps:

1) before the first washing drum performs water drainage;

2) determining whether the second washing drum is running a procedure;

3) if the determination result is yes, executing step 4), and if the determination result is no, the first washing drum performing water drainage;

4) determining whether the second washing drum is draining water;

5) if the determination result is yes, the first washing drum waiting until the second washing drum finishes water drainage, and then draining, and if the determination result is no, the first washing drum performing water drainage;

The water drainage control procedure of the embodiment achieves control of the water drainage procedure, adopts sequential control logic, and is simple to implement an easy to control. Only one drum drains water at any moment, which ensures the reliability of water drainage without causing the problem of water pollution between the two drums. Moreover, vibration caused by dewatering is detected, and the gravity center of the overall structure is lowered with the weight of the clothes and washing water in the drums, to achieve the effect of vibration and noise reduction.

Described above are just preferred embodiments of the present disclosure, rather than limitations to the present disclosure in any form. The present disclosure has been disclosed above with the preferred embodiments, which are however not intended to limit the present disclosure. Any technical person familiar with the patent can make some alterations or modifications to form equivalent embodiments with equivalent changes using the technical contents indicated above without departing from the scope of the technical solutions of the present disclosure. All simple alterations, equivalent changes and modifications made to the above embodiments based on the technical essence of the present disclosure without departing from the contents of the technical solutions of the present disclosure should still be encompassed within the scope of the technical solutions of the present disclosure.

The invention claimed is:

1. A control method of a double-drum washing machine, the washing machine at least comprises a first washing drum and a second washing drum, wherein, whether a heating time required by the first washing drum is overlong or not is judged before the first washing drum performs heating, if yes, the second washing drum preferentially executes a heating, or a dewatering, or a drying process, if not, the following step is performed:

step S101: judging whether the second washing drum performs heating or not;

step S102: if yes, judging whether a remaining heating time of the second washing drum is greater than $T_0$ or not;

step S103: if yes, executing an alternate heating program that the first washing drum and the second washing drum perform heating alternately, and if not, executing an ordered heating program that the second washing drum performs heating firstly, and then the first washing drum performs heating, wherein $T_0$ is a time value set in the method for judging whether a heating of the second washing drum is about to finish or not;

and wherein a judgement on whether the heating time required by the first washing drum is overlong or not comprises following judgement conditions:

a) whether a set heating temperature of the first washing drum is higher than a normal set temperature or not;

b) whether a water intake quantity of the first washing drum is greater than a common water intake quantity or not;

c) whether a difference of a set heating temperature value and a real-time measurement value of the first washing drum is greater than a difference of a set heating temperature value and a real-time measurement value of the second washing drum or not;

if all judgement results in a), b) and c) are not, determining that the heating time required by the first washing drum is not overlong; and if any one of the judgement results in a), b) and c) is yes, determining that the heating time required by the first washing drum is overlong.

2. The control method of the double-drum washing machine according to claim 1, wherein, the normal set temperature in the judgment condition a) accounts for 60%-90% of a maximum heating temperature set in a system.

3. The control method of the double-drum washing machine according to claim 1, wherein, the common water intake quantity in the judgement condition b) accounts for 80%-95% of a maximum water intake quantity set in a system.

4. The control method of the double-drum washing machine according to claim 1, wherein, the first washing drum is provided with a plurality of water intake water levels which correspond to different water intake quantities, the common water intake quantity corresponds to a common water intake water level, the common water intake water level is higher than a minimum water intake water level and lower than a maximum water intake water level, a judgement according to the judgement condition b) is realized in the following manners:

judging whether a water intake water level set for the first washing drum is higher than the common water intake quantity or not, if yes, determining that a water intake quantity set for the first washing drum is greater than the common water intake quantity, if not, determining that the water intake quantity set for the first washing drum is smaller than the common water intake quantity.

5. The control method of the double-drum washing machine according to claim 1, wherein, when a judgement result of judging whether the heating time needed by the first washing drum is overlong is not, executes the following judgement:

it is judged whether the second washing drum is performing any one of the heating, or the dewatering, or the drying process, if yes, the first washing drum waits until the corresponding heating, or dewatering, or heating process of the second washing drum is completed and then to heat, If not, the first washing drum performs heating.

6. The control method of the double-drum washing machine according to claim 1, wherein, a total heating time of the second washing drum is $T_{m2}$, and $0<T_0\leq\frac{1}{3}T_{m2}$.

7. The control method of the double-drum washing machine according to claim 1, wherein, in the alternate heating program in step S103:

after a heating time interval of the first washing drum reaches $T_1$, it is judged whether a temperature of the first washing drum is equal to a preset temperature, if yes, the first washing drum stops heating and the second washing drum keeps heating to a preset temperature, if not, the first washing drum pauses heating and the second washing drum heats, after a heating time interval of the second washing drum reaches $T_2$, it is judged whether a temperature of the second washing drum is equal to the preset temperature, if yes, the second washing drum stops heating and the first washing drum keeps heating to the preset temperature, if not, the second washing drum pauses heating and the first washing drum heats.

8. The control method of the double-drum washing machine according to claim 7, wherein, $T_1$ and $T_2$ are respective minimum time intervals when the first washing drum and the second washing drum perform heating every time.

9. The control method of the double-drum washing machine according to claim 1, wherein, the first washing drum is independently provided with a first heating means for heating the first washing drum, and the second washing drum is independently provided with a second heating means for heating the second washing drum, the first washing drum and the second washing drum are respectively provided with a first sensor and a second sensor for monitoring a water intake water level.

10. The control method of the double-drum washing machine according to claim 2, wherein, the normal set temperature accounts for 70%-80% of the maximum heating temperature set in the system.

11. The control method of the double-drum washing machine according to claim 2, wherein, the normal set temperature is 60° C.

12. The control method of the double-drum washing machine according to claim 3, wherein, the common water intake quantity accounts for 95%-95% of the maximum water intake quantity set in the system.

13. The control method of the double-drum washing machine according to claim 3, wherein, the first washing drum is provided with a plurality of water intake water levels which correspond to different water intake quantities, the common water intake quantity corresponds to a common water intake water level, the common water intake water level is higher than a minimum water intake water level and lower than a maximum water intake water level, a judgement according to the judgement condition b) is realized in the following manners:

judging whether a water intake water level set for the first washing drum is higher than the common water intake quantity or not, if yes, determining that a water intake quantity set for the first washing drum is greater than the common water intake quantity, if not, determining that the water intake quantity set for the first washing drum is smaller than the common water intake quantity.

14. The control method of the double-drum washing machine according to claim 6, wherein, $0<T_0\leq 5$ min.

15. The control method of the double-drum washing machine according to claim 8, wherein $T_1$ is equal to $T_2$.

* * * * *